United States Patent [19]

Chapin

[11] Patent Number: 4,635,363

[45] Date of Patent: Jan. 13, 1987

[54] HAND OPERATED CUTTING TOOL

[75] Inventor: David S. Chapin, Raleigh, N.C.

[73] Assignee: Cooper Industries, Inc., Houston, Tex.

[21] Appl. No.: 626,390

[22] Filed: Jun. 29, 1984

[51] Int. Cl.[4] ..... B26B 13/12; B26B 13/20

[52] U.S. Cl. ..... 30/257; 30/341

[58] Field of Search ..... 30/254, 256, 257, 259, 30/341, 260

[56] References Cited

U.S. PATENT DOCUMENTS

| | | | |
|---|---|---|---|
| 85,500 | 12/1868 | Witte | 30/341 |
| D. 251,701 | 5/1979 | Hayashi . | |
| 743,658 | 11/1903 | Polkowski | 30/260 |
| 880,967 | 3/1908 | Broadbrooks . | |
| 1,005,661 | 10/1911 | Shirt | 30/260 |
| 1,103,710 | 7/1914 | Tourjee | 30/341 |
| 2,203,541 | 6/1940 | Muserlain | 30/266 |
| 2,370,026 | 2/1945 | Elia . | |
| 2,939,213 | 6/1960 | Daniel | 30/260 |
| 3,046,655 | 7/1962 | Sproson | 30/233 |
| 3,170,237 | 2/1965 | Weidauer | 30/268 |
| 3,175,291 | 3/1965 | Nardo | 30/254 |
| 3,289,296 | 12/1966 | Hedstrom et al. | 30/267 |
| 3,453,731 | 7/1969 | Wertepny, Sr. | 30/267 |
| 3,524,363 | 8/1970 | Wertepny, Sr. | 76/104 |
| 3,711,950 | 1/1973 | Students | 30/254 |
| 3,825,020 | 7/1974 | Myers | 30/254 X |
| 3,869,792 | 3/1975 | Laurenti | 30/254 |
| 4,453,311 | 6/1984 | Twigger | 30/254 |

*Primary Examiner*—Jimmy C. Peters

*Attorney, Agent, or Firm*—Finnegan, Henderson, Farabow, Garrett & Dunner

[57] ABSTRACT

A hand operated cutting tool, having a pair of blades pivotally connected together at a pivot point and having a handle joined to each blade, is provided. A relatively short handle on one of the blades extends upwardly and rearwardly from a line defined by the blade points and the pivot point. A ring is attached to a short handle to receive the thumb of the user. A relatively long handle is on the other blade and it extends upwardly and rearwardly. The long handle receives the user's fingers in a line substantially parallel to the line defined by the blade points and the pivot point.

25 Claims, 8 Drawing Figures

HAND OPERATED CUTTING TOOL

FIELD OF THE INVENTION

The present invention relates generally to hand operated cutting tools and, more particularly, to hand operated cutting tools, such as shears, snips, or scissors, that are ergonomically designed.

BACKGROUND OF THE INVENTION

Various hand operated cutting tools, such as scissors, shears, and snips, have over the years been designed in a variety of shapes and sizes. Unfortunately, these previous cutting tools have not been adapted to the user's hand so as to allow for the comfortable use of the tool. Rather, previous cutting tools typically cause user stress, fatigue, and strain, even when used for only a brief time period. The typical cutting tool does not provide for proper alignment between the user's hand and the tool to improve the cutting capability of the tool, while decreasing user stress, fatigue, and strain.

For example, previous cutting tool manufacturers often do not design the handles of the tool so that the hand is in a relaxed and natural position during the cutting operation. Typically, the user's thumb is postioned within a handle of the scissors, snips, or shears so as to lie almost perpendicular to the line of cut. Such a positioning increases the stress and strain placed on the hand muscles.

Consequently, the user experiences hand fatigue more quickly than if the scissors, snips, or shears were designed in accordance with ergonomic principles. Likewise, in the typical household scissors, snips, or shears, the third or ring finger and the fourth or little finger may be forced into awkward positions within the palm of the hand during the cutting operation so as to be out of the way, instead of being used to operate the tool.

The science of ergonomics attempts to adapt machines and tools to the people using the machine or tool. The ergonomist strives to shape the design of the machine or tool to the user to eliminate, or at least minimize, user stress, fatigue, and strain. By decreasing the stress, fatigue, and strain caused by the use of the machine or tool, the user's productivity and comfort are consequently increased.

SUMMARY OF THE INVENTION

Accordingly, it is an objective of the present invention to minimize user stress, strain, and fatigue in a hand operated cutting tool.

Another objective of the invention is to incorporate ergonomic principles into a hand operated cutting tool.

Another objective of the invention is to provide a hand operated cutting tool that is comfortable to use.

It is also an objective of the present invention to increase the precision and control over the cutting operation with a hand operated cutting tool.

To achieve these objectives, the present invention provides a hand operated cutting tool that comprises: a first blade and a second blade, said blades being substantially parallel and pivotally connected together at a pivot point, the blades being thereby pivotable into an open position and into a closed position defining a plane therebetween, and in a closed position terminating in points substantially defining a line with the pivot point; a relatively short handle on one of the blades extending upwardly and rearwardly from the line, the short handle including a thumb-receiving means formed in an end thereof opposite the blade and including means for applying a thumb-induced force for pivoting the blade on the short handle about the pivot point; and a relatively long handle on the other of the blades extending upwardly and rearwardly at a lesser angle with respect to the line defined by the blade points and the pivot point than the upwardly and rearwardly extending short handle for the substantially vertical alignment of the handles along the area of the plane, the long handle then extending rearwardly and curving slightly downwardly for receiving the fingers curved thereabout in a line substantially parallel to the line defined by the blade points and the pivot point.

The present invention overcomes the inherent disadvantages of previous hand operated cutting tools since it is comfortable to use without causing significant user stress, strain, or fatigue. Unlike previous cutting tools, the present invention incorporates ergonomic principles so that the hand operated cutting tool of the present invention provides better directional control along the cutting line; allows the user's hand to assume a more relaxed and natural position; and results in a straighter, more relaxed wrist position. This natural and relaxed positioning of the hand and wrist improves the user's visibility of the cut line, and reduces fatigue, stress, and strain in the hand and wrist.

The foregoing and other objectives, features, and advantages of the present invention will be made more apparent from the following description of the preferred embodiments.

BRIEF DESCRIPTION OF THE DRAWINGS

The accompanying drawings, which are incorporated in and constitute a part of the specification, illustrate an embodiment of the invention and, together with the description, serve to explain the principles of the invention.

DESCRIPTION OF THE PREFERRED EMBODIMENT

Reference will now be made in detail to the present preferred embodiment of the present invention, an example of which is illustrated in the accompanying drawings.

Figure 1:
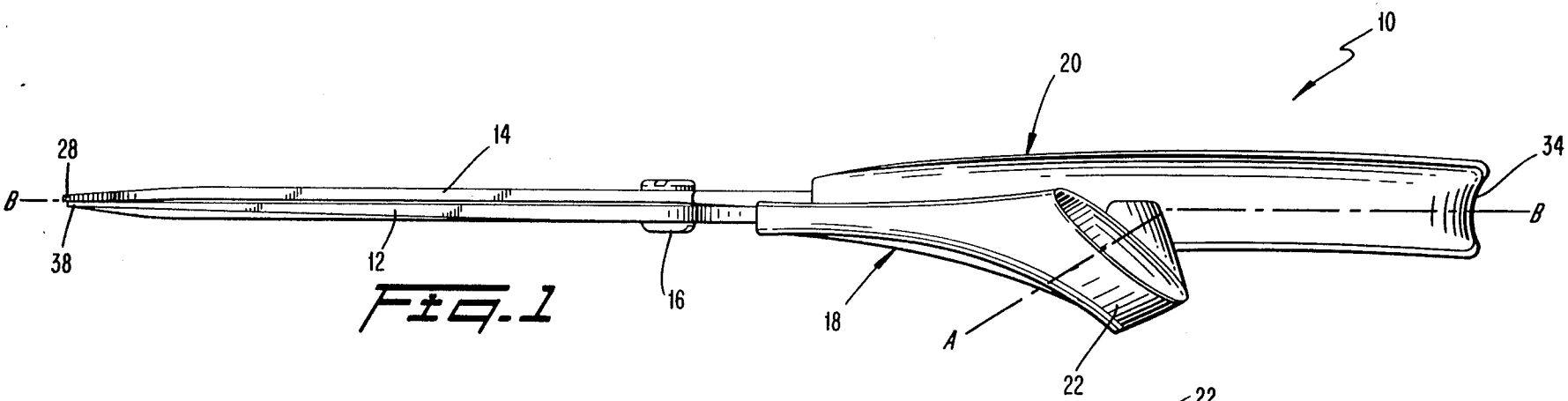
FIG. 1 is a top view of the hand operated cutting tool of the present invention.
Figure 2:
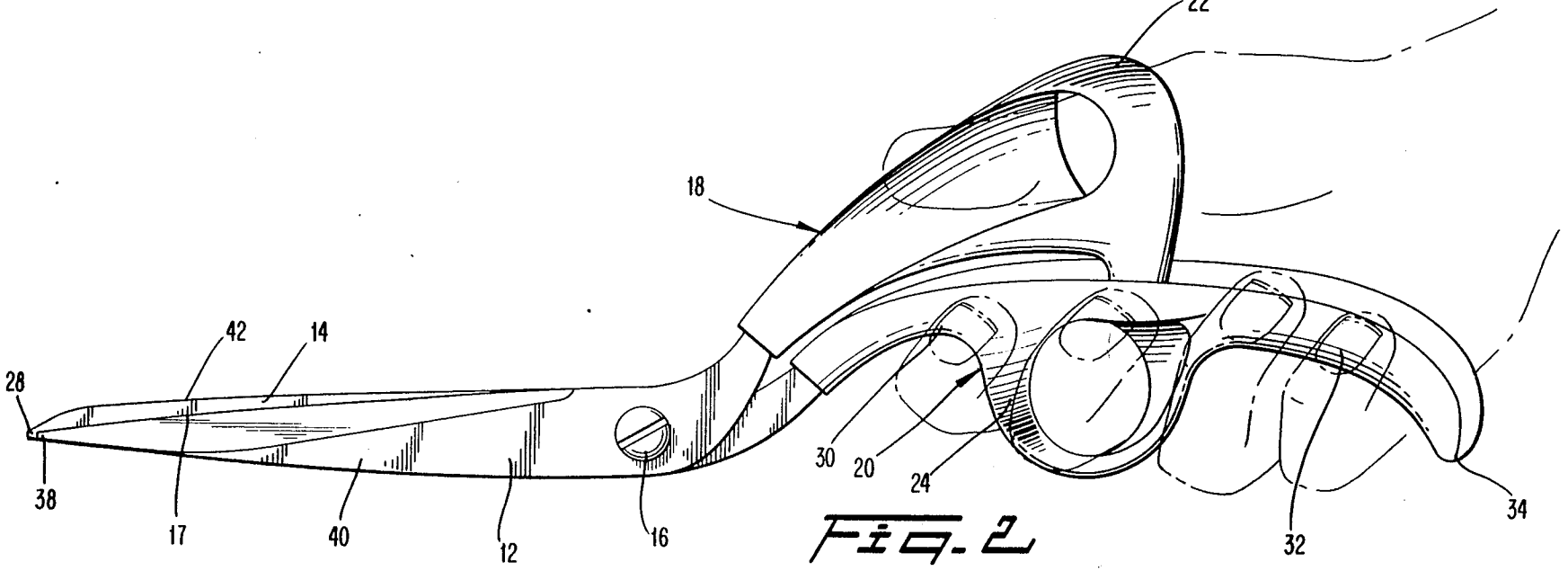
FIG. 2 is a side view of the tool in the right hand of a user.
Figure 3:
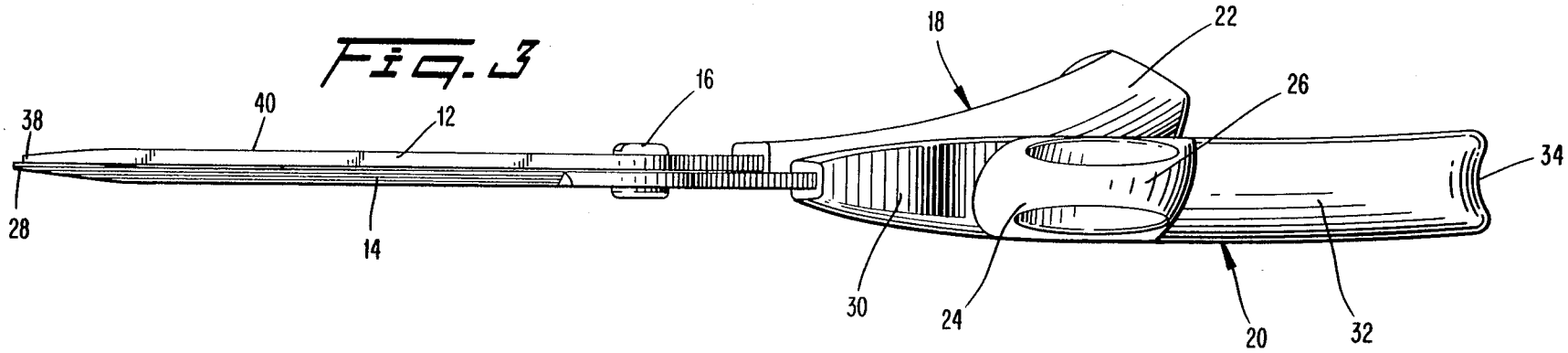
FIG. 3 is a bottom view of the tool.

In accordance with the present invention, as shown in FIGS. 1 to 3, a hand operated cutting tool 10 has a pair of cooperating blades and a pair of cooperating handles. The pair of blades comprises a first blade 12 and a second blade 14 pivotally connected together along a pivot point 16. The first and second blades 12 and 14 pivot in opposite directions during the cutting operation.

The blades 12 and 14 are pivotable into an open position and into a closed position to define a plane therebetween. The blades 12 and 14 each terminate in points 38 and 28 that substantially define a line with the pivot point 16 when the blades 12 and 14 are in a closed position.

Each blade has a cutting edge, such as cutting edge 17 on the first blade 12. The pair of handles comprise a relatively short handle 18 joined to the first blade 12 and a relatively long handle 20 joined to the second blade 14.

The short handle 18, as shown in FIG. 2, extends upwardly and rearwardly from the line defined by the blade points 38 and 28 and the pivot point 16 when the blades 12 and 14 are closed. The short handle 18 includes a thumb-receiving means in an end opposite the first blade 12 and a means for applying a thumb-induced force for pivoting the blade 12 on the short handle 18 about the pivot point 16. The thumb receiving means preferably includes a continuous or discontinuous ring having a central axis diverging from the plane, defined between the blades 12 and 14, at an angle of less than 45°.

In the preferred embodiment, the thumb-receiving and force applying means comprises ring 22 attached to the short handle 18. As illustrated in FIG. 1, the central axis (A) of the ring 22 and the plane (B) between the blades together form an angle of less than 45°. Preferably, this angle is in the range of 30° to 35° because such angle not only substantially aligns the user's thumb in the ring 22 with the line of the cut, but also permits sufficient side pressure to be placed on the cooperating blades in the cutting action. If this angle is near 0°, many thumbs would not be able to provide the necessary side pressure. Consequently, the blades would lie parallel to each other without coming into contact and, hence, the tool would not be very effective as a cutting instrument. The ring 22 can be either a continuous band, as in FIGS. 1–5, or a discontinuous band.

In contrast to the present invention, previous cutting tools, such as scissors, snips, or shears, generally maintain an angle of 50° to 55° between the central axis of the short ring for the thumb and the plane between the blades. The reduction in angle in the cutting tool 10 allows the user's thumb, which is inserted in the ring 22 as shown in FIG. 2, to be more aligned with the direction of cut than in previous cutting tools. Consequently, this alignment provides better directional control for the user and allows the hand to assume a more relaxed and natural position when using the cutting tool.

A relatively long handle 20 is on the second blade 14. The long handle 20 extends upwardly and rearwardly at a lesser angle with respect to the line defined by the blade points 38 and 28 and the pivot point 16 than the upwardly and rearwardly extending short handle 18. As a result, the short handle 18 and the long handle 20 are in substantially vertical alignment along the area of the plane between the blades 12 and 14. The long handle 20 extends rearwardly and curves slightly downwardly for receiving the fingers curved thereabout in a line substantially parallel to the line defined by the blade points 28 and 38 and the pivot point 16.

A ring 24 is preferably attached to the long handle 20. The ring 24 is positioned on the long handle 20 to divide the long handle 20 into a seat portion 30 and a tail portion 32, as shown in FIGS. 2 and 3. The ring 24 aids in pivoting the blade 14 of the long handle 20 about the pivot point 16. Preferably, the central axis of the ring 24 is substantially perpendicular to the plane (B) between the blades.

In one embodiment, illustrated in FIG. 2 and 3, the ring 24 on the long handle 20 receives one finger of the user's hand, such as the middle or second finger. The seat portion 30 then accommodates the index or first finger and the tail portion 32 accommodates both the ring or third finger and the little or fourth finger of the user. Some users, however, may insert the first or index finger in the ring 24 and place the remaining fingers around the tail portion 32.

Alternatively, the ring 24 on the long handle 20 may receive two or more fingers of the user's hand. The seat portion 30 and the tail portion 32 then accommodate the remaining fingers. The long handle 20 can also have two or more rings 24 each capable of receiving one or more fingers of the user's hand.

The long handle 20 also is slightly bent at the end of the tail portion 32 downwardly toward the ring 24 to provide an end stop 34. The end stop 34 prevents the user's hand, particularly the third and fourth fingers, from sliding off of the long handle 20 during the use of the tool.

Figure 5:
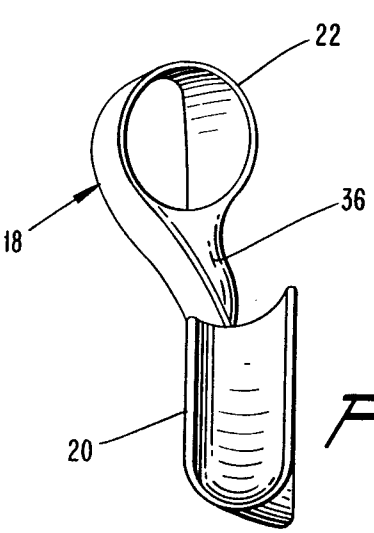
FIG. 5 is an end view of the tool as viewed from the handles.
Figure 4:
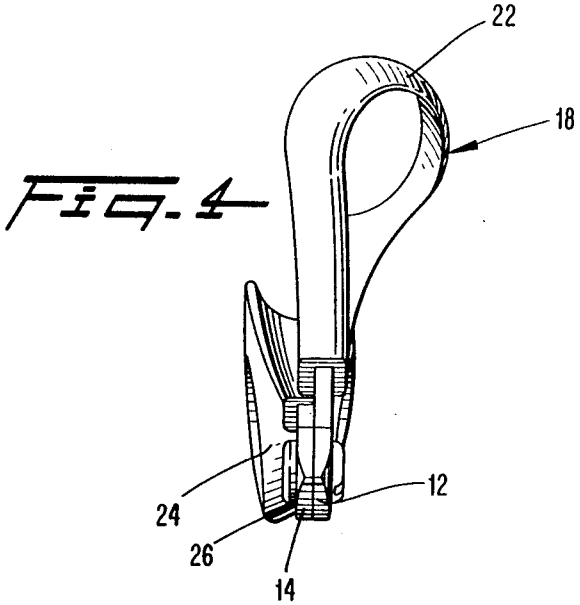
FIG. 4 is an end view of the tool as viewed from the blade tips.
Figure 6:
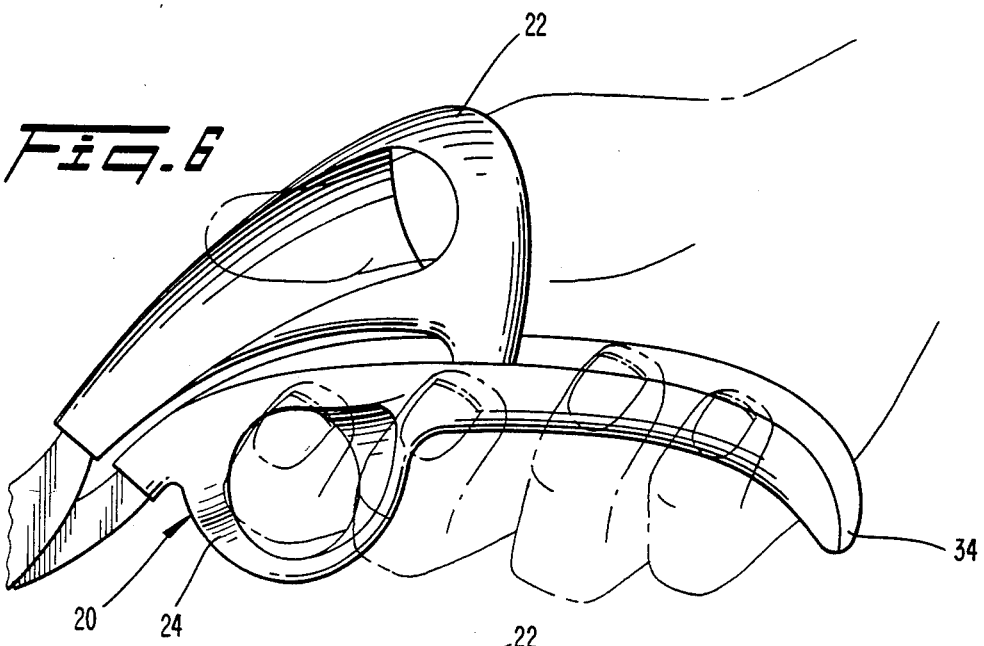
FIG. 6 is side view of an alternative embodiment of the hand operated cutting tool of the present invention.
Figure 7:
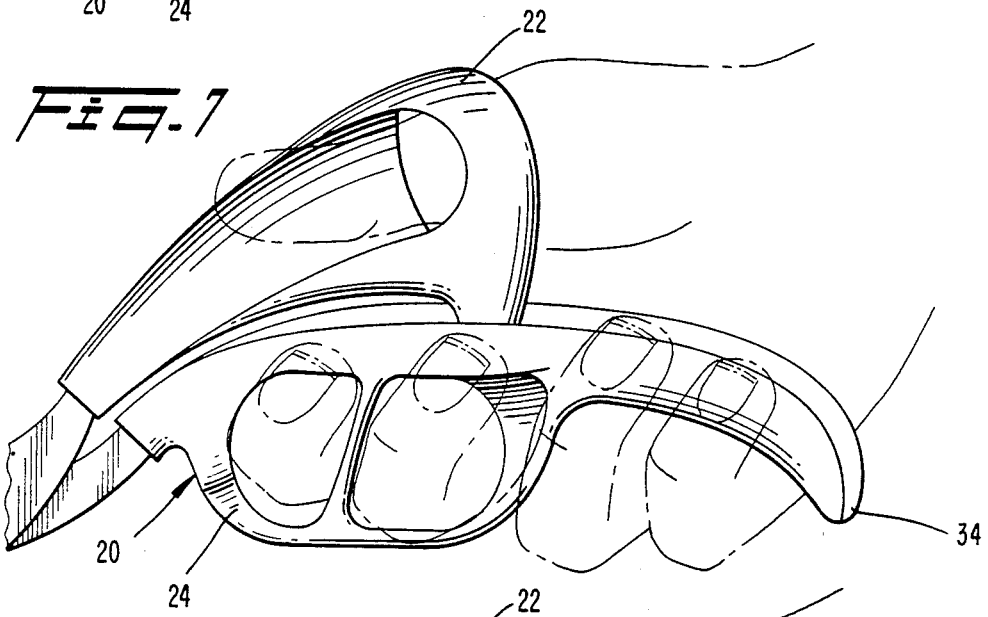
FIG. 7 is a side view of another embodiment of the hand operated cutting tool of the present invention.
Figure 8:
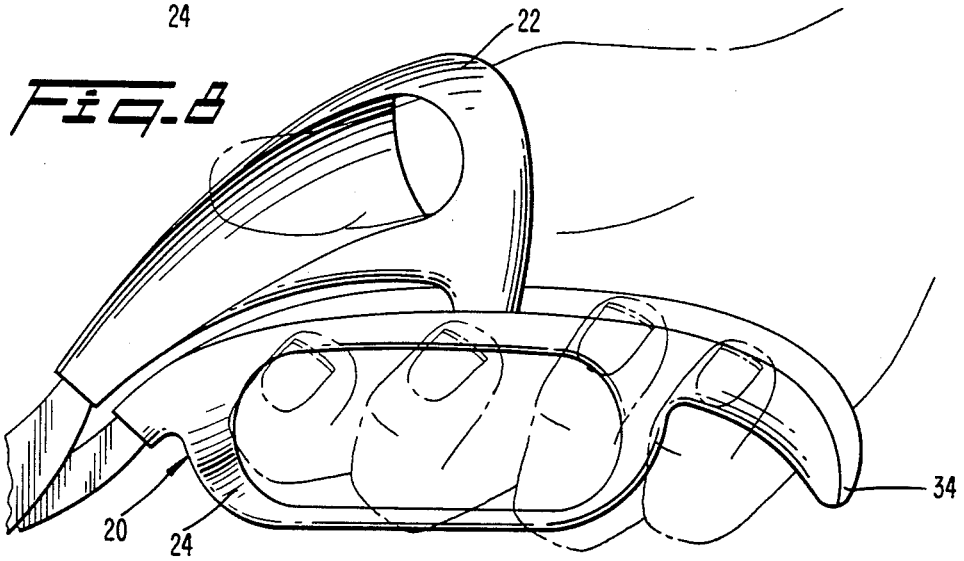
FIG. 8 is a side view of still another embodiment of the hand operated cutting tool of the present invention.

As depicted in FIG. 5, a nib 36 is attached to the exterior of the ring 22 at the point the ring 22 touches the long handle 20 when the cutting tool is in a closed position. The nib 36 aligns the handles 18 and 20 and, consequently, the blades 12 and 14, so that the second blade tip 28 and the first blade tip 38 just meet.

The pivot point 16 is a conventional nail hole that allows the cooperating blades to be connected pivotally together. Various fastening means, such as a screw or rivet, can be used in the nail hole.

Preferably, the blades 12 and 14 are made of a metal, such as steel, to provide the requisite cutting edge. The handles 18 and 20 are preferably made of a plastic to lessen the tool's weight.

The non-cutting edges 40 and 42 of the blades 12 and 14 can be curved to prevent the blades 12 and 14 from digging into the work surface. The blade tips 28 and 38 can be tapered to allow fine cutting in difficult to reach places.

It will be apparent to those skilled in the art that various other modifications and variations could be made in the structure of the present invention without departing from the scope and content of the invention.

What is claimed is:

1. A hand operated cutting tool comprising:

(a) a first blade and a second blade, said blades being stantially parallel and pivotally connected at a pivot point, the blades being hereby pivotable into an open position and into closed position defining a plane therebetween, and in a closed position terminating in points substantially defining a line with said pivot point;

(b) a relatively short handle on one of the blades extending upwardly and rearwardly from the line, the short handle including a thumb-receiving means formed in an end thereof opposite the blade, the thumb-receiving means including a central axis diverging from the plane at an angle of greater than 0° and less than 45°, the angle being selected to allow sufficient side pressure to be placed on the cooperating blades in the cutting action, and including means for applying a thumb-induced force for pivoting the blade on the short handle about the pivot point; and (c) a relatively long handle on the other of the blades extending upwardly and rearwardly at a lesser angle with respect to the line defined by the blade points and the pivot point than the upwardly and rearwardly extending short handle for the substantially vertical alignment of the handles along the area of the plane, the long handle then extending rearwardly and curving slightly downward for receiving the fingers curved thereabout in a line substantially parallel to the line defined by the blade points and the pivot point.

2. The hand operated cutting tool of claim 1, wherein the central axis of the thumb-receiving means diverges from the plane at an angle in the range of 30° to 35°.

3. The hand operated cutting tool of claim 1, wherein the thumb-receiving means and applying means is a ring attached to the short handle.

4. The hand operated cutting tool of claim 3, wherein a central axis of the ring diverges from the plane at an angle in the range of 30° to 35°.

5. The hand operated cutting tool of claim 1, wherein the long handle has a ring for receiving one or more fingers of the user's hand.

6. The hand operated cutting tool of claim 5, wherein the ring on the long handle receives one finger of the user's hand.

7. The hand operated cutting tool of claim 6, wherein the ring on the long handle accommodates the first finger of the user's hand.

8. The hand operated cutting tool of claim 6, wherein the ring on the long handle accommodates the second finger of the user's hand.

9. The hand operated cutting tool of claim 5, wherein the ring on the long handle divides the long handle into a seat portion and a tail portion.

10. The hand operated cutting tool of claim 9, wherein the seat portion accommodates the first finger of the user's hand.

11. The hand operated cutting tool of claim 9, wherein the tail portion of the long handle accommodates the third finger and the fourth finger of the user's hand.

12. The hand operated cutting tool of claim 9, wherein the tail portion is curved to fit within the palm of the user's hand.

13. The hand operated cutting tool of claim 5, wherein the central axis of the ring on the long handle is substantially perpendicular to the plane between the blades.

14. The hand operated cutting tool of claim 1, wherein a central long handle has two or more rings each capable of receiving one or more fingers of the user's hand.

15. The hand operated cutting tool of claim 1, wherein the non-cutting edges of the blades are curved.

16. The hand operated cutting tool of claim 1; wherein the tips of the blades are tapered.

17. The hand operated cutting tool of claim 1, wherein the short handle and the long handle are both made of a plastic.

18. The hand operated cutting tool of claim 1, wherein the blades are both made of a metal.

19. A hand operated cutting tool comprising:

(a) a first blade and a second blade, said blades being substantially parallel and pivotally connected at a pivot point, the blades being thereby pivotable into an open position and into a closed position defining a plane therebetween, and in a closed position terminating in points substantially defining a line with said pivot point;

(b) a relatively short handle on one of the blades extending upwardly and rearwardly from the line, the short handle including a thumb-receiving means formed in an end thereof opposite the blade, the thumb-receiving means including a central axis diverging from the plane at an angle of greater than 0° and less than 45°, the angle being selected to allow sufficient side pressure to be placed on the cooperating blades during the cutting action, and including means for applying a thumb-induced force for pivoting the blade on the short handle about the pivot point; and (c) a relatively long handle on the other of the blades extending upwardly and rearwardly at a lesser angle with respect to the line defined by the blade points and the pivot point than the upwardly and rearwardly extending short handle for the substantially vertical alignment of the handles along the area of the plane, the long handle then extending rearwardly and curving slightly downwardly for receiving the fingers curved thereabout in a line substantially parallel to the line defined by the blade points and the pivot point, the long handle having a ring for receiving one or more fingers.

20. The hand operated cutting tool of claim 19, wherein the central axis of the thumb-receiving means diverges from the plane at an angle in the range of 30° to 35°.

21. The hand operates cutting tool of claim 19, wherein the thumb-receiving means and applying means is a ring attached to the short handle.

22. A hand operated cutting tool comprising:

(a) a first blade and a second blade, said blades being substantially parallel and pivotally connected at a pivot point, the blades being thereby pivotable into an open position and into a closed position defining a plane therebetween, and in a closed position terminating in points substantially defining a line with said pivot point;

(b) a relatively short handle on one of the blades extending upwardly and rearwardly from the line, the short handle including a thumb-receiving means formed in an end thereof opposite the blade, the thumb-receiving means including a central axis diverging from the plane at an angle in the range of 30° to 45° and including means for applying a thumb-induced force for pivoting the blade on the short handle about the pivot point; and (c) a relatively long handle on the other of the blades extending upwardly and rearwardly at a lesser angle with respect to the line defined by the blade points and the pivot point than the upwardly and rearwardly extending short handle for the substantially vertical alignment of the handles along the area of the plane, the long handle then extending rearwardly and curving slightly downwardly for receiving the fingers curved thereabout in a line substantially parallel to the line defined by the blade points and the pivot point.

23. The hand operated cutting tool of claim 22, wherein the central axis of the thumb-receiving means diverges from the plane at an angle in the range of 30° to 35°.

24. A hand operated cutting tool comprising:

(a) a first blade and a second blade, said blades being substantially parallel and pivotally connected at a pivot point, the blades being thereby pivotable into an open position and into a closed position defining a plane therebetween, and in a closed position terminating in points substantially defining a line with said pivot point;

(b) a relatively short handle on one of the blades extending upwardly and rearwardly from the line, the short handle including a thumb-receiving means formed in an end thereof opposite the blade, the thumb-receiving means including a central axis diverging from the plane at an angle in the range of 30° to 45° and including means for applying a thumb-induced force for pivoting the blade on the short handle about the pivot point; and (c) a relatively long handle on the other of the blades extending upwardly and rearwardly at a lesser angle with respect to the line defined by the blade points and the pivot point than the upwardly and rearwardly extending short handle for the substantially vertical alignment of the handles along the area of the plane, the long handle then extending rearwardly and curving slightly downwardly for receiving the fingers curved thereabout in a line substantially parallel to the line defined by the blade points and the pivot point, the long handle having a ring for receiving one or more fingers.

25. The hand operated cutting tool of claim 24, wherein the central axis of the thumb-receiving means diverges from the plane at an angle in the range of 30° to 35°.

* * * * *